US011072409B2

(12) United States Patent
Nilsson

(10) Patent No.: US 11,072,409 B2
(45) Date of Patent: Jul. 27, 2021

(54) METHOD FOR OPERATING A MARINE VESSEL COMPRISING A PLURALITY OF PROPULSION UNITS

(71) Applicant: VOLVO PENTA CORPORATION, Gothenburg (SE)

(72) Inventor: Sebastian Nilsson, Gothenburg (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 0 days.

(21) Appl. No.: 16/348,062

(22) PCT Filed: Nov. 14, 2016

(86) PCT No.: PCT/EP2016/077578
§ 371 (c)(1),
(2) Date: May 7, 2019

(87) PCT Pub. No.: WO2018/086714
PCT Pub. Date: May 17, 2018

(65) Prior Publication Data

US 2019/0283855 A1 Sep. 19, 2019

(51) Int. Cl.
*B63H 20/00* (2006.01)
*B63H 25/42* (2006.01)

(52) U.S. Cl.
CPC ..... *B63H 21/265* (2013.01); *B63H 25/42* (2013.01); *B63H 20/00* (2013.01); *B63H 2020/003* (2013.01)

(58) Field of Classification Search
CPC ..... B63H 21/265; B63H 25/42; B63H 20/00; B63H 2020/003
See application file for complete search history.

(56) References Cited

U.S. PATENT DOCUMENTS 6,234,853 B1 5/2001 Lanyi et al.
7,398,742 B1 * 7/2008 Gonring ..... B63H 5/125 114/144 A (Continued)

FOREIGN PATENT DOCUMENTS

EP 2343236 A1 7/2011
EP 2727818 A1 5/2014
WO 2015122805 A1 8/2015

OTHER PUBLICATIONS

International Search Report dated Jul. 17, 2017 in International Application No. PCT/EP2016/077578.

(Continued)

*Primary Examiner* — Anthony D Wiest
(74) *Attorney, Agent, or Firm* — Venable LLP; Jeffri A. Kaminski

(57) ABSTRACT

The invention provides a method for operating a marine vessel (1) comprising a plurality of propulsion units (106, 107, 108, 206, 207, 208), each being arranged to deliver thrust to water in which the vessel (1) is floating, the thrust delivery levels of the propulsion units (106, 7, 108, 206, 207, 208) being individually controllable, the method comprising controlling (S2) a first (106, 207) of the propulsion units so as to deliver a thrust in a direction (T106, T207) which has a component in a first direction (F) of the vessel, simultaneously controlling (S2) a second (107, 208) of the propulsion units so as to deliver less thrust than the first propulsion unit (106, 207), and subsequently increasing (S4) the thrust delivered by the 10 second propulsion unit (107, 208) in a direction (T107, T208) which has a component in the first direction (F), the method further comprising simultaneously with increasing the thrust delivered by the second propulsion unit (107, 208) decreasing (S5) the thrust delivered by the first propulsion unit (106, 207).

15 Claims, 10 Drawing Sheets

(56) References Cited

U.S. PATENT DOCUMENTS

| | | | | |
|---|---|---|---|---|
| 8,589,004 | B1 * | 11/2013 | Kanno | B63H 25/42 701/21 |
| 8,807,059 | B1 * | 8/2014 | Samples | B63H 25/42 114/144 R |
| 9,132,903 | B1 | 9/2015 | Gable et al. | |
| 2006/0019552 | A1 | 1/2006 | Okuyama | |
| 2010/0191396 | A1 | 7/2010 | Nose et al. | |
| 2011/0166724 | A1 * | 7/2011 | Hiramatsu | B63H 25/42 701/21 |
| 2012/0231681 | A1 | 9/2012 | Shibayama | |
| 2015/0127197 | A1 | 5/2015 | Lindeborg | |

OTHER PUBLICATIONS

International Preliminary Report on Patentability dated Oct. 15, 2018 in International Application No. PCT/EP2016/077578.
China Office Action dated Sep. 30, 2020 in corresponding China Patent Application No. 201680090823.5, 10 pages.

* cited by examiner

METHOD FOR OPERATING A MARINE VESSEL COMPRISING A PLURALITY OF PROPULSION UNITS

TECHNICAL FIELD

The invention relates to a method operating a marine vessel comprising a plurality of propulsion units, each being arranged to deliver thrust to water in which the vessel is floating. The invention also relates to a computer program, a computer readable medium, a control unit, a marine propulsion control system, and a marine vessel.

The invention is not restricted to any particular type of marine vessel. Instead it may be used on any type and any size of marine vessel, water surface vessels as well as submarines.

BACKGROUND

In a marine propulsion control system for controlling a set of propulsion units carried by a hull of a vessel, cavitation typically occurs on the propulsion unit with reverse gear engaged. For example in a sway maneuver where one propulsion unit is in a forward gear and another propulsion unit is in a reverse gear, the engine for the reversing propulsion unit may need to be controlled at a relatively high rotational speed for the thrust of the forwarding propulsion unit to be matched and for compensating for the cavitation loss. This may cause a high level of noise and a high fuel consumption. The cavitation may occur at propellers of the propulsion units. The propellers are usually designed to rotate in one of two directions. More specifically, the profiles of the propeller blades are usually designed for rotation of the propellers in one of two directions. If a propeller is rotated in the opposite direction, such as when the propulsion unit presenting the propeller is operated in a reverse gear, the cavitation may occur due to the profiles of the blades interacting with the water in a way for which they are not designed. The cavitation may result in a "grip" of the propellers in the water being reduced.

It is known to use, in a sway maneuver of a vessel with in a triple propulsion unit installation, a center propulsion unit to increase the reverse thrust and thereby limit the rotational speeds of engines for propulsion units in reverse gears, so that the cavitation effect is limited, and simultaneously allow for a higher thrust on the forwarding propulsion unit, thus increasing the total thrust for the vessel. US2015127197 describes a sway maneuver based on input from a user handled joystick, and as the joystick is increasingly tilted, a center propulsion unit goes from being idle to reversing for assisting another reversing propulsion unit. Methods of similar kind are disclosed in WO 2015/122805, describing a method corresponding to the preamble of claim 1 of the present application, and in US 2006/019552, U.S. Pat. No. 6,234,853, US 2012/231681 and EP 2 343 236.

The amount of force required to control motions of a vessel may depend on external factors, such as wind, current, waves. The ability of a vessel control system to provide the exact amount of force required determines its performance. In addition, low speed features such as docking and virtual anchoring, also referred to as digital anchoring or a position hold function, require low accelerations and jerk levels. There is thus a desire to improve vessel control systems so as to reduce accelerations and jerk levels, in particular during low speed maneuvers, such as sway at docking.

SUMMARY

An object of the invention is to improve the control of marine vessels so as to reduce accelerations and jerk levels, in particular during low speed maneuvers.

The object is reached with a method according to claim 1. Thus the object is reached with a method for operating a marine vessel comprising a plurality of propulsion units, each being arranged to deliver thrust to water in which the vessel is floating, the thrust delivery levels of the propulsion units being individually controllable, the method comprising controlling a first of the propulsion units so as to deliver a thrust in a direction which has a component in a first direction of the vessel, simultaneously controlling a second of the propulsion units so as to deliver less thrust than the first propulsion unit, and subsequently increasing the thrust delivered by the second propulsion unit in a direction which has a component in the first direction, the method further comprising simultaneously with increasing the thrust delivered by the second propulsion unit decreasing the thrust delivered by the first propulsion unit.

As exemplified below, increasing the thrust delivered by the second propulsion unit may involve engaging gear of the second propulsion unit, whereby the thrust thereof is increased from zero to a non-zero value. However, in some embodiments, the thrust of the second propulsion unit may be increased from a non-zero value to a higher non-zero value.

Each propulsion unit being arranged to deliver thrust to the water may involve each propulsion unit is arranged to transfer power from a power source, such as an internal combustion engine or an electric motor, to the water.

It is understood that a thrust delivery direction having a component in the first direction means that the thrust delivery direction has a positive component in the first direction. As exemplified below, the first direction of the vessel may be a forward direction of the vessel. Thus controlling the first and second propulsion units so as to deliver thrusts in directions which have components in the first direction may involve operating the first and second propulsion units in reverse gears so as to direct their thrusts at least partially, depending on their steering angles, in a forward direction of the vessel. Thus, the invention may provide for reducing the thrust from a propulsion unit already engaged in reverse gear, as an additional unit is engaged in reverse gear. Where the propulsions units comprise propellers, controlling the first and second propulsion units so as to deliver thrusts in directions which have components in the first direction may involve controlling the first and second propulsion units so that the propellers of the first and second propulsion units rotate in a direction which is opposite to the direction for which they are designed.

The engagement of the second propulsion unit may provide a stepwise increase in the thrust thereof, e.g. from zero thrust to a thrust provided with a gear engaged and at an idle operation of an engine for the second propulsion unit. The decrease of the thrust delivered by the first propulsion unit may offset the thrust increase from the second propulsion unit at the gear engagement thereof. Thereby sudden changes in thrust as additional drive units are engaged may be avoided. This will decrease accelerations and jerk levels in the vessel operation.

Preferably, each of the propulsion units comprises a propeller. Thereby, the invention may be advantageously applied to propulsion units which are particularly sensitive to cavitation in a reverse mode. The propulsion units may be provided e.g. as outboard engines mounted at a stern of the vessel, stern drives or pod drives.

Preferably, controlling the second propulsion unit so as to deliver less thrust than the first propulsion unit comprises controlling the second propulsion unit so as to deliver substantially no thrust. This may be effected e.g. by keeping a coupling or a clutch for a gear engagement of the second propulsion unit disengaged. Increasing the thrust delivered by the second propulsion unit may involve changing the gear of the second propulsion unit from a neutral position to a reverse position.

Preferably, the steps of increasing the thrust delivered by the second propulsion unit and decreasing the thrust delivered by the first propulsion unit are carried out within a propulsion unit engagement time interval, and the sum of the thrusts in directions which have components in the first direction is substantially the same immediately before and immediately after the propulsion unit engagement time interval. Thereby, the sum of the increased thrust delivered by the second propulsion unit and the decreased thrust delivered by the first propulsion unit is equal to the sum of the thrusts delivered by the first and second propulsion unit during the step of controlling the second propulsion unit so as to deliver less thrust than the first propulsion unit.

As suggested, the second propulsion unit may be controlled to deliver no thrust during the step of controlling the second propulsion unit so as to deliver less thrust than the first propulsion unit. Thereby, increasing the thrust of the second propulsion unit may involve engaging a gear of the second propulsion unit. Thus, embodiments of the invention may ensure that the sum of the reverse thrusts after the second propulsion unit engagement is equal to the reverse thrust of the first propulsion unit prior to the engagement. Thereby, it is possible to achieve a smooth increase in the total reverse thrust when the second propulsion unit is engaged. Further, it is possible to reduce noise by avoiding high engine speeds for the reversing propulsion units. Thereby, at the transition from one to two propulsion units delivering thrust in reverse gear, the combined thrust is made continuous and smooth.

Preferably, where the propulsion units are arranged to be controlled with control signals representing a requested thrust of the propulsion units, the steps of increasing the thrust delivered by the second propulsion unit and decreasing the thrust delivered by the first propulsion unit are carried out at a unit engagement requested thrust, and within a requested thrust interval including the unit engagement requested thrust, the sum of the thrusts in directions which have components in the first direction increases smoothly with an increasing requested thrust. The control signals representing a requested thrust of the propulsion units may involve the signals coding the requested torque, or it may involve the signals coding a parameter the values of which changes with the requested torque, such as the rotational speed of power sources for the propulsion units. The thrust sum increasing smoothly preferably involves thrust sums following a smooth function of the requested thrust. In some embodiments, the thrust sum may increase linearly with an increasing requested thrust. Thereby, avoiding jerking of the vessel at the increase of the second propulsion unit thrust may be secured.

Preferably, where the propulsion units are arranged to be controlled with control signals representing a requested thrust of the propulsion units, for each thrust in a direction which has a component in the first direction, the degree of increase with an increasing requested thrust, of an output torque of a respective power source for driving the respective propulsion unit, is inversely proportional to the number of propulsion units delivering thrusts in directions which have components in the first direction. As mentioned, the power sources may be engines or motors. In the case of engines, the output torque may be controlled as known per se e.g. by a throttle or by fuel injection adjustments. As also mentioned, increasing the thrust of the second propulsion unit may involve engaging a reverse gear of the second propulsion unit, and the first direction may be a forward direction of the vessel. Thus, by the degree of increase with an increasing requested thrust, of the respective power source output torque, being inversely proportional to the number of propulsion units delivering reverse thrusts, it may be ensured that the sum of the thrusts increase to the same degree before and after the engagement of the second propulsion unit.

As mentioned, the first direction may be a forwards direction of the vessel. Thereby, the invention may be applied to cavitation sensitive reversing propellers, providing thrusts in the forward direction of the vessel, thereby urging the vessel rearwards. As also suggested, the reverse thrust from an already engaged unit may be reduced as an additional unit is engaged, and the sum of the reverse thrusts immediately after the additional unit engagement may be equal to the reverse thrust immediately prior to the additional unit engagement.

Preferably, where the thrust delivery directions of the propulsion units are individually controllable, the method involves, during the step of controlling the second propulsion unit so as to deliver less thrust than the first propulsion unit, and during the steps of increasing the thrust delivered by the second propulsion unit and decreasing the thrust delivered by the first propulsion unit, controlling a third of the propulsion units so as to deliver a thrust in a direction which has a component in a direction of the vessel which is opposite to the first direction.

Where the first direction is the forward direction of the vessel, the third propulsion unit delivering a thrust in a direction which has a component in a direction which is opposite to the first direction, means that the third propulsion unit delivers a thrust in the rearwards direction of the vessel, urging the vessel forwards.

In embodiments with such a third propulsion unit thrust delivery, the thrusts of the first, second and third propulsion units may have directions with components in one of two sideways directions of the vessel, which sideways directions are horizontal and perpendicular to an intended direction of straight travel of the vessel, wherein said thrust components are in the same sideways direction. Thereby, a sway movement or a sideways motion of the vessel may be effected. Thus, a vessel operator may demand a transverse thrust, upon which a control system initially uses two units engaged in a forward and a reverse gear, respectively. An increased demand for a lateral force may result in the reverse thrust being provided from more than one propulsion unit. When an additional drive unit is engaged in reverse, the output torque or the engine speed of power sources of one or more engaged propulsion units is reduced in order to achieve a smooth increase in the total thrust. Thus, embodiments of the invention provide a method that will allow the vessel to be displaced in a transverse direction with a smoothly and gradually increasing lateral force.

For providing a sway movement of the vessel, the first and third propulsion units may be located on opposite sides of a longitudinal center line of the vessel, and the second propulsion unit is located between the first and third propulsion units. Thus during sway movements with propulsion units comprising propellers, despite the grip of propellers usually being lower in a reverse operation compared to a forward operation, excessive engine noise and fuel consumption may be avoided due to the stepwise addition of reversing propulsion units for matching the propulsion of a forwarding propulsion unit. As suggested, the thrust decrease of propulsion unit already engaged in reverse will mitigate the sudden potential increase in reverse thrust by engaging an extra propulsion unit.

As understood, the stepwise addition of reversing propulsion units for matching the propulsion of a forwarding propulsion unit may involve adding a reversing propulsion unit which is inboard of a propulsion unit already reversing. For example, a sway movement with an increasing requested thrust may start with forwarding and reversing the most outboard propulsion units, and subsequently adding one or more reversing propulsion units in the order in which they are positioned laterally from the already reversing propulsion unit(s) towards the forwarding propulsion unit (s). However, it should be noted that the invention is equally 30 applicable to other temporal to spatial correlations for engaging reversing propulsion units. For example, the first propulsion unit engaged in reverse during a sway movement may be inboard of a propulsion unit engaged in reverse subsequently.

For providing a sway movement of the vessel, the thrust of the first, second and/or third propulsion unit may intersect a center of buoyancy of the vessel. Thereby, it may be secured that the vessel will not yaw during the sway movement. However, by providing steering angles such that thrusts do not intersect the center of buoyancy, a combined translational and rotational movement may be provided if requested.

In some embodiments, the method comprises, simultaneously with the step of controlling the second propulsion unit so as to deliver less thrust than the first propulsion unit, controlling a third of the propulsion units so as to deliver less thrust than the first propulsion unit, and, simultaneously with increasing the thrust delivered by the second propulsion unit, increasing the thrust delivered by the third propulsion unit in a direction which has a component in the first direction. Thereby, the second and third propulsion units may be located on opposite sides of a longitudinal center line of the vessel, and the first propulsion unit is located between the second and third propulsion units.

In such examples, the propulsion units may be controlled to move the vessel rearwards. Examples of applications may include slow rearwards driving e.g. at docking, or a so called virtual anchoring, e.g. at fuelling, fishing or a sole operator preparing docking. In the case of virtual anchoring, reason for a forwardly directed thrust from the propulsion units may be wind or a tidal current tending to move the vessel forwards.

At a relatively low requested total thrust, only a center propulsion unit may be engaged. As the requested total thrust increases, propulsion units on opposite sides of the center propulsion unit may be engaged, and simultaneously, the thrust of the center propulsion unit may be decreased, so as to provide a smooth increase of the total thrust at engagement of the additional propulsion units, similarly to embodiments described above.

The objects are also reached with a computer program, a computer readable medium, a control unit, a marine propulsion control system, and a marine vessel.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples. In the drawings.

DETAILED DESCRIPTION OF EXAMPLE EMBODIMENTS OF THE INVENTION

Figure 1:
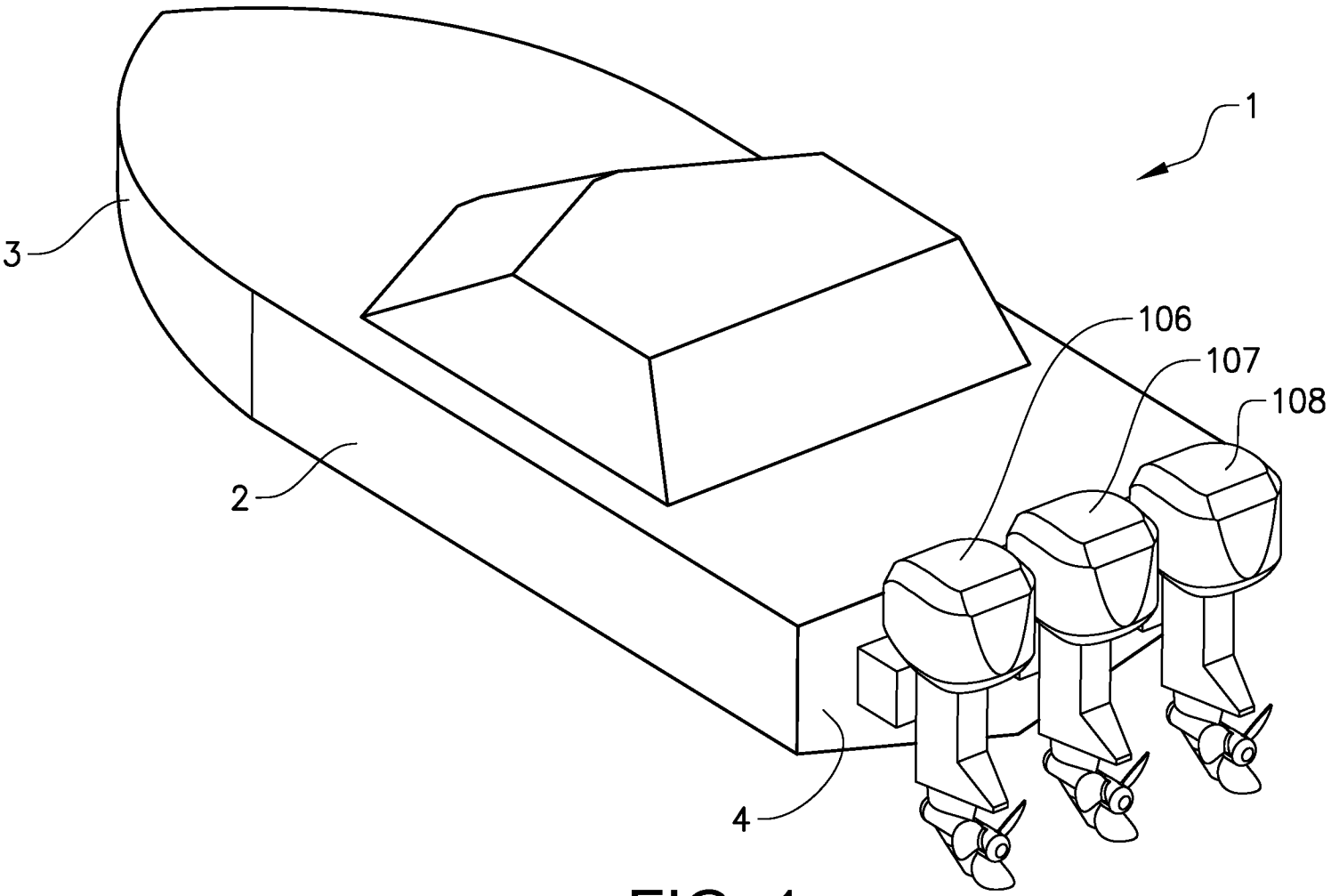
FIG. 1 is a perspective view of a marine vessel.

FIG. 1 shows a perspective view of a marine vessel 1 in the form of a small power boat, in which an embodiment of the invention is used. Generally, a marine propulsion control system according to an embodiment of the inventive concept may be used in any type of water surface vessel, such as a large commercial ship, a boat for transport of goods and/or people, a leisure boat and another type of marine surface vessel.

As further schematically illustrated in FIG. 1, the vessel 1 presents a hull 2 having a bow 3, a stern 4. The vessel presents two symmetrical portions on opposite sides of a longitudinal center line running from the bow 3 to the stern 4, and being parallel to an intended direction of straight travel of the vessel.

In the stern 4, three propulsion units 106, 107, 108 in the form of outboard engines are mounted. More precisely, the vessel 1 is provided with a first propulsion unit 106 arranged towards the port side of the vessel, a second propulsion unit 107 arranged in the center and a third propulsion unit 108 arranged towards the starboard side of the vessel. Each propulsion unit comprises a propeller arranged to be driven by a power source in the form of an internal combustion engine. However, in alternative embodiments, the propellers may be driven by e.g. electric motors.

Each propulsion unit 106, 107, 108 is arranged to deliver thrust to water in which the vessel 1 is floating. The thrust delivery levels of the propulsion units 106, 107, 108 are individually controllable. I.e. the thrust level of one of the propulsion units may be adjusted independently of the thrust levels of any of the remaining propulsion units.

The propulsion units 106, 107, 108 are pivotally arranged in relation to the hull 2 for generating a driving thrust in a desired direction. More specifically, each propulsion unit may be rotated in relation to the hull 2 around a steering axis which may be substantially vertical. Further, the rotational positions of the propulsion units may the controlled individually. I.e. the rotational position of one of the propulsion units may be adjusted independently of the rotational positions of any of the remaining propulsion units. Thereby, the thrust delivery directions of the propulsion units 106, 107, 108 are individually controllable.

The propulsion units 106, 107, 108 may alternatively sterndrives or pod drives arranged to be driven by power sources in the form of inboard engines or motors. Such propulsion units may be mounted on the hull 2 under the vessel or on the stern 4.

Figure 2:
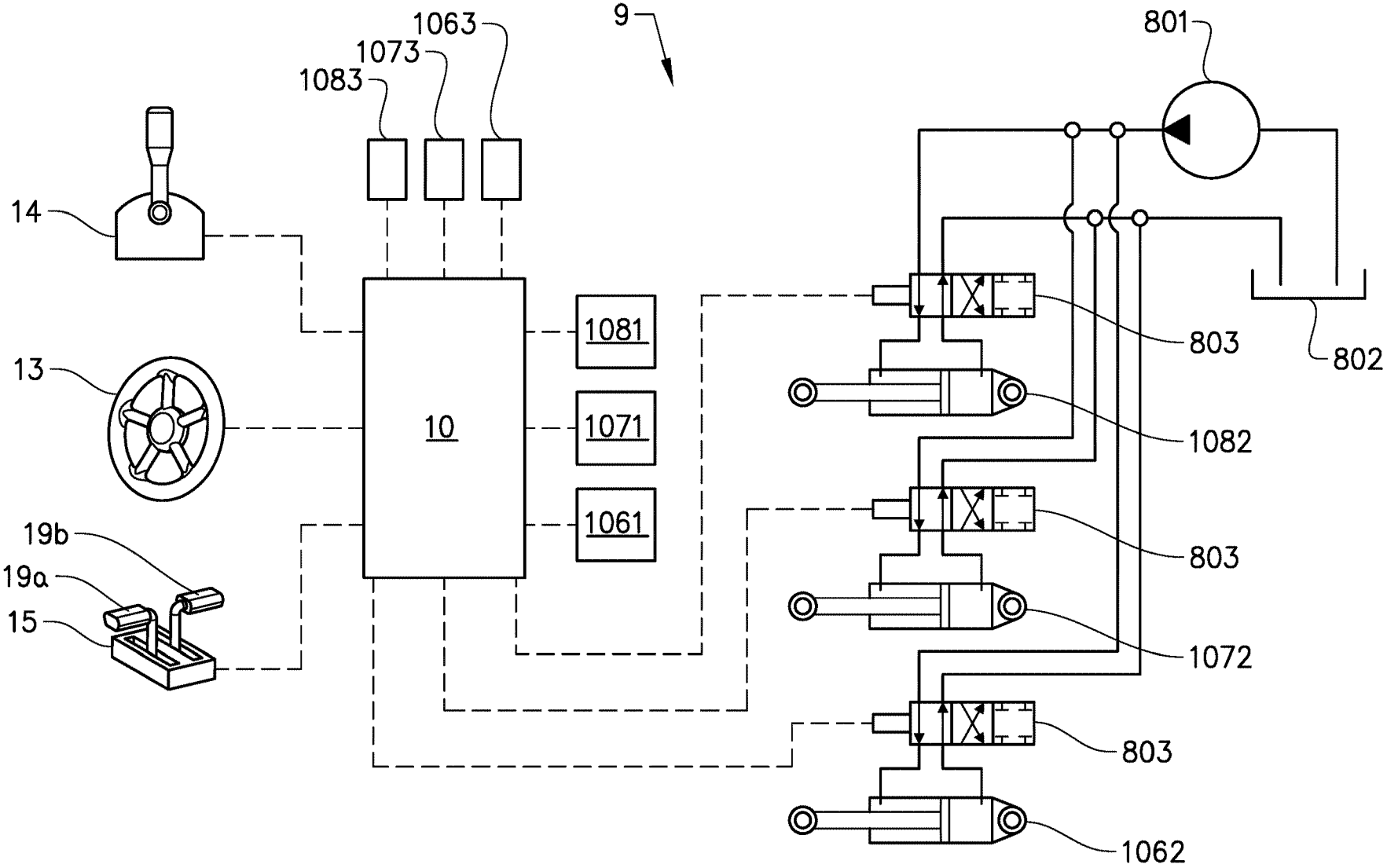
FIG. 2 is a diagram of a marine propulsion control system for the vessel in FIG. 1.

Reference is made to FIG. 2. The control of the propulsion units 106, 107, 108 are performed by a marine propulsion control system 9. The control system includes a control unit 10, which may be provided as one physical unit, or a plurality of physical units arranged to send and receive control signals to and from each other. The control unit 10 may comprise computing means such as a CPU or other processing device, and storing means such as a semiconductor storage section, e.g., a RAM or a ROM, or such a storage device as a hard disk or a flash memory. The storage section can store settings and programs or schemes for interpreting input commands and generation control commands for controlling the propulsion units 106, 107, 108.

The control system further includes user command input devices including a steering wheel 13, a joystick 14 and a thrust regulator 15. The control unit 10 is arranged to receive control signals from the user command input devices 13, 14, 15. It should be noted that, instead of a joystick, a set of buttons, a touch screen or equivalent, may be provided.

The propulsion control system 9 comprises a thrust controller 1061, 1071, 1081 for each propulsion unit 106, 107, 108. Each thrust controller 1061, 1071, 1081 is adapted to control the thrust level of a respective of the propulsion units. For example, the thrust controllers 1061, 1071, 1081 may be arranged to adjust throttles and/or the fuel injection of the engines arranged to drive the propellers of the propulsion units 106, 107, 108. The control unit 10 is arranged to send control signals to the thrust controllers 1061, 1071, 1081.

Control signals in the control system may be sent through communication lines or wirelessly.

Each propulsion unit 106, 107, 108 includes a gear selector 1063, 1073, 1083, a steering actuator 1062, 1072, 1082, and a steering angle detector (not shown). Each gear selector 1063, 1073, 1083 is arranged to change gear for the respective propulsion unit between a forward propulsion position, a reverse propulsion position, and a neutral position. The gear selectors 1063, 1073, 1083 are arranged to receive signals from the control unit 10 so as to be controlled thereby.

Each steering actuator 1062, 1072, 1082 is arranged to turn the respective propulsion unit about the steering axis and thereby alter the thrust direction of the propulsion unit. The steering actuators 1062, 1072, 1082 may include e.g. a hydraulic cylinder or an electrical motor. In this example, each steering actuator 1062, 1072, 1082 is a hydraulic cylinder. A hydraulic system is provided for powering the hydraulic cylinders 1062, 1072, 1082. The hydraulic system comprises a hydraulic pump 801 arranged to pump hydraulic fluid from a hydraulic fluid container 802 to proportional valves 803. Each proportional valve 803 is arranged to be controlled by the control unit 10 so as to selectively guide hydraulic fluid to the respective hydraulic cylinder 1062, 1072, 1082 and back towards the hydraulic fluid container 802.

Each steering angle detector is arranged detect an actual steering angle of the respective propulsion unit 106, 107, 108. In this example, each steering angle detector is a stroke sensor for the respective hydraulic cylinder 1062, 1072, 1082. However, the steering angle detectors may be any means for measuring or calculating the steering angle.

The control unit 10 contains means for mapping input signals from the user command input devices 13, 14, 15 to reference settings for the gear selectors 1063, 1073, 1083, to reference steering angle values for the propulsion units 106, 107, 108, and to reference thrust level values for the propulsion units 106, 107, 108. The thrust controllers 1061, 1071, 1081 are arranged to be controlled so as to set the thrust level of the propulsion units 106, 107, 108 such that they assume the respective reference thrust level values. The respective thrust levels are controlled by controlling the respective propeller rotational speed.

The steering actuators 1062, 1072, 1082 are arranged to be controlled so as to move the propulsion units 106, 107, 108 such that they assume the respective reference angle value. The steering angle detectors are arranged to provide feedback signals to the control unit 10 so that a closed loop control of the propulsion unit steering angles may be provided.

The control unit 10 may thus control operations of the propulsion units, through controlling the individually for each of the propulsion units the gear selection, delivered thrust and steering angle. The controlled operations are based at least partly on the input commands from the user command input devices 13, 14, 15.

The vessel comprises a further user command input device in the form of a command device selector (not shown). With this selector, a driver of the vessel may select whether the steering and thrust of the propulsion units are controlled based on input from the steering wheel 13 and the thrust regulator 15, or based on input from the joystick 14. For high speed, medium speed and some low speed operations the steering wheel 13 and the thrust regulator 15 may be selected as control input devices.

For certain low speed operations, e.g. at docking, the joystick may be selected as a control input device. Such operations will be exemplified below. The joystick is arranged to provide vessel directional control as well as vessel speed control. The control unit 10 is arranged to map positions of the joystick to commands for movements of the vessel. Thereby, the joystick 14 may be used to provide commands for translational movements, rotational movements or combinations thereof, such as sway, surge or yaw movements of the vessel. Thus, a user may through the joystick 14 supply the control unit with an input command for e.g. port sway and clockwise yaw of the vessel.

The joystick 14 is arranged to assume a neutral position when not tilted by a user. The joystick 14 may be tilted in any direction from the neutral position, i.e. forward, rearward, leftward and rightward, and any direction in between these directions. Joystick tilting provide commands for translational movements of the vessel. A forward or rearward joystick tilts provide commands for surge movements of the vessel, and leftward and rightward joystick tilts provide commands for sway movements of the vessel. In addition, increasing the degree of tilting of the joystick will increase the propulsion unit thrust levels, and vice versa, e.g. to increase the speed of the translational movement or to counteract an increasing wind acting on the vessel.

Moreover, the joystick 14 may also be rotated so as to issue an operating instruction for achieving a yaw movement of the vessel 1. Rotating the joystick when in the neutral position will provide a command for a pure rotational movement of the vessel. Commands for combinations of translational and rotational movements are provided with combined tilting and rotation of the joystick. For example, when an operator tilts the joystick to the port side and rotates it clockwise the propulsion units are controlled such that the vessel 2 moves in a sway movement to port with a clockwise rotation.

An additional user command input device (not shown) may be provided, e.g. in the form of a switch, which is arranged to be manipulated by a user, so as to selectively activate an automatic vessel movement or positioning control. The control unit 10 may be arranged to provide control signals for such an automatic control, e.g. based on signals from a GPS (Global Positioning System) device provided in the vessel. An example of such an automatic control is a virtual anchoring function, where the propulsion units 106, 107, 108 are controlled to keep the vessel in a location. In a virtual anchoring function the propulsion units 106, 107, 108 may work against a current, such as a tide current.

Figure 3:
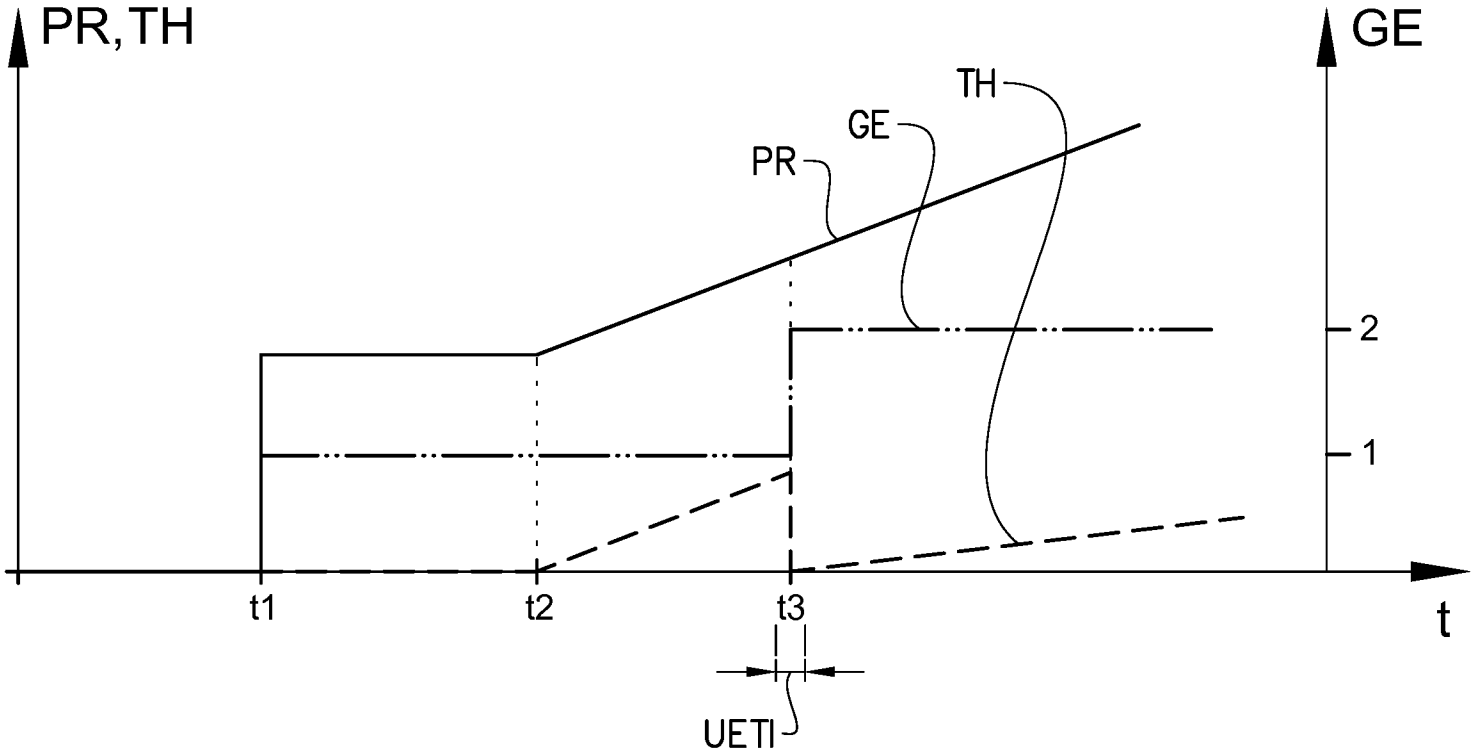
FIG. 3 is a diagram of parameters in the control system in FIG. 2 as functions of time.

Reference is made to FIG. 3. In an example, at a first point in time t1 an operator of the vessel starts tilting the joystick 14 to port to obtain the vessel sway movement to port.

Figure 4:
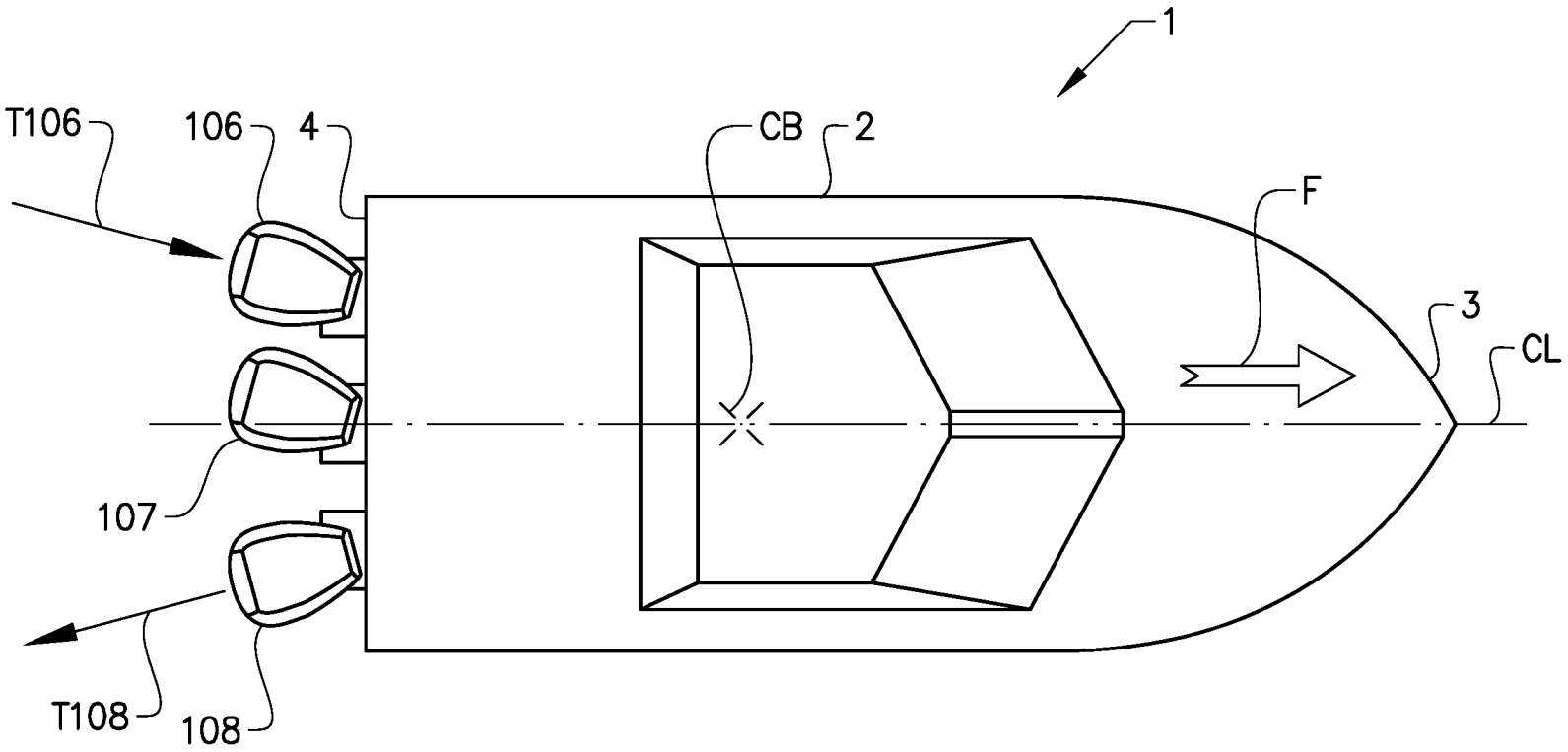
FIG. 4 is a top view of the vessel in FIG. 1.

As can be seen in FIG. 4, the first and third propulsion units 106, 108 are located on opposite sides of a longitudinal center line CL of the vessel, and the second propulsion unit 107 is located between the first and third propulsion units 106, 108. FIG. 4 illustrates the steering angles and the thrust levels of the propulsion units 106, 107, 108 as a result of the operator joystick 14 tilting to port to achieve the port sway movement. The arrows T106, T107, T108 indicate the directions of thrusts delivered by the propulsion units 106, 107, 108 to the water in which the vessel 1 is floating.

In this example, for ease of understanding, it is assumed that the operator increases the degree of joystick tilting linearly with time, to obtain an increased speed of the vessel sway movement. Of course in practice an increase of the joystick tilting to obtain an increased speed of the vessel sway movement may be done non-linear manner, e.g. stepwise.

Figure 5:
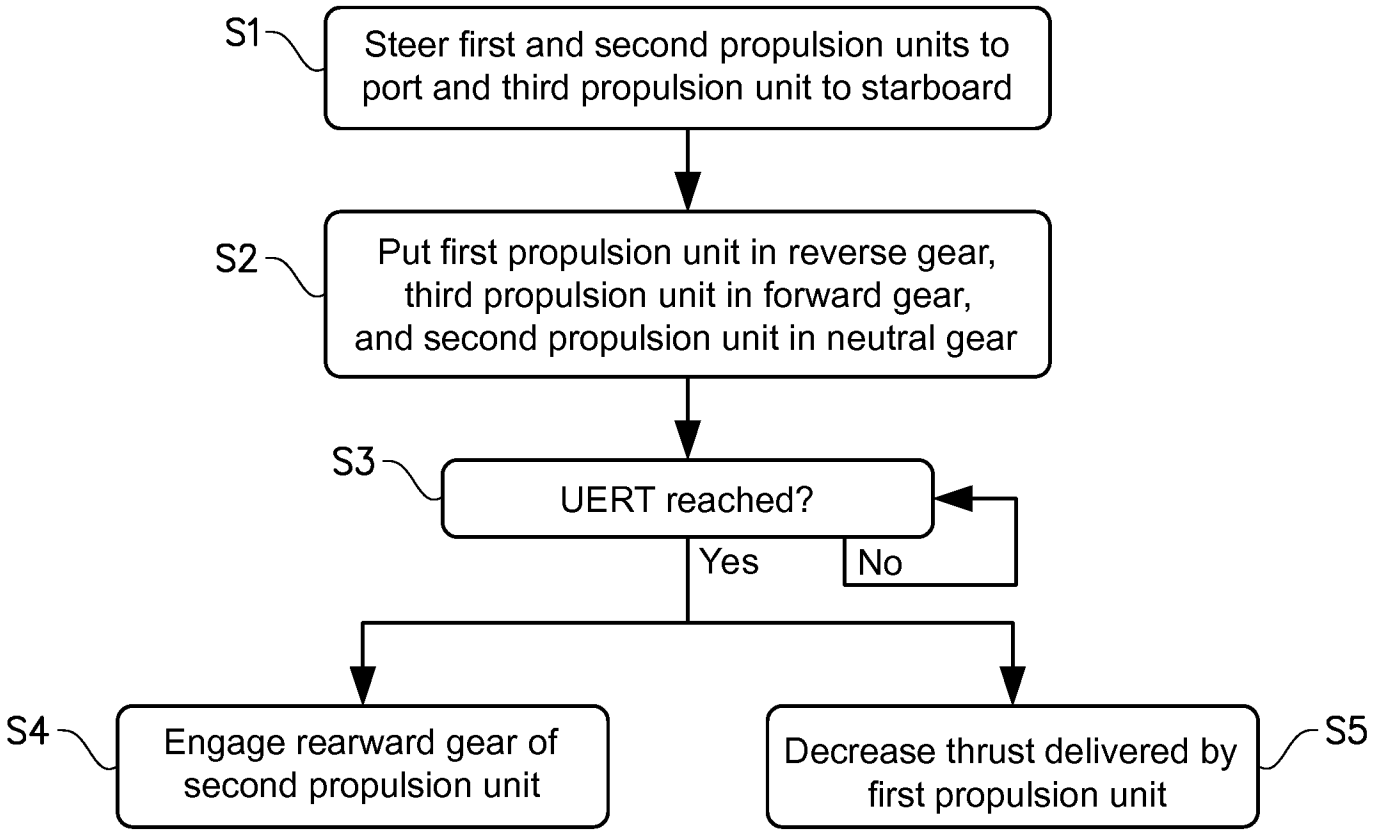
FIG. 5 is a block diagram depicting steps in a method performed in the control system in FIG. 2.

Reference is made also to FIG. 5. When the operator start tilting the joystick at the first point in time t1, the control unit controls the propulsion units 106, 107, 108 so as to assume the steering angles shown in FIG. 4. I.e. the first and second propulsion units 106, 107 will be 10 steered S1 to port and the third propulsion unit will be steered to starboard. Also, the first propulsion unit 106 will be put S2 in a reverse gear, and the third propulsion unit will be put in a forward gear. The second propulsion unit will be in a neutral gear and will therefore not deliver any thrust at this stage.

In FIG. 3, GE indicates the number of propulsion units in reverse gear, PR indicates the combined thrust of the propulsion units in reverse gear, and TH indicates the throttle settings of the engines the propulsion units in reverse gear. It should be noted that as is well known a throttle setting may be used to control the output torque of a gasoline engine. Where diesel engines are provided, the injected fuel amount may the used to control the output torque.

From the first point in time t1, until a third point in time t3, when a requested thrust of the first propulsion unit has reached a unit engagement requested thrust UERT, discussed below, only the first and second propulsion units 106, 108 contribute to the sway movement.

As can be seen in FIG. 4, the first propulsion unit 106 is controlled so as to be in a reverse gear and deliver a thrust in a direction T106 which has a component in a first direction F of the vessel, in this example the forward direction F of the vessel. The third propulsion unit 108 is controlled so as to be in a forward gear and deliver a thrust in a direction T108 which has a component in a direction which is opposite to the forward direction F of the vessel. Again, the second propulsion unit 107 is controlled so as to deliver no thrust. The force components from the first and third propulsion units 106, 108 in the forward direction F sum up to be zero, and thus the vessel 1 will not surge either forwardly or backwardly. Also, the thrusts of the first and third propulsion units 106, 108 have directions with components in one of the sideways directions of the vessel, i.e. in the starboard direction. Thereby, the reaction forces of the water will force the vessel to port.

It should be further noted that the steering angles of the first and third propulsion units 106, 108 are controlled so that the thrusts of the first and third propulsion units 106, 108 both intersect a center of buoyancy CB of the vessel 1. Thereby, it is secured the vessel will not yaw during the sway movement. However, by providing steering angles such that thrusts do not intersect the center of buoyancy CB, a combined translational and rotational movement may be provided if requested.

In FIG. 3, the gear engagement GE, at the first point in time t1, of the first propulsion unit 106 is indicated. As the operator increases the joystick tilting to port, at a second point in time t2 the throttle setting TH of the engine for the first propulsion unit 106 starts to increase. It is understood that also the throttle setting (not indicated) of the engine for the third propulsion unit 108 will increase. Between the first and second point in time t1, t2 the engine is idling, and hence there is no increase in thrust as the joystick tilting increases; this is discussed also below with reference to FIG. 7.

As the efficiency of the propeller of the propulsion unit with the reverse gear engaged is lower, e.g. due to cavitation, than the efficiency of the propeller of the propulsion unit with the forward gear engaged, the throttle setting TH of the engine for the first propulsion unit 106 will be increased faster than the throttle setting of the engine for the third propulsion unit 108.

At the third point in time t3, within a propulsion unit engagement time interval UETI, the unit engagement requested thrust UERT, described below, is reached S3. At the third point in time t3 the thrust delivered by the second propulsion unit 107 is increased from zero to a non-zero value by engaging S4 the rearward gear GE thereof. At the gear engagement of the second propulsion unit 107, there is a discontinuous increase of the thrust from the second propulsion unit.

Figure 6:
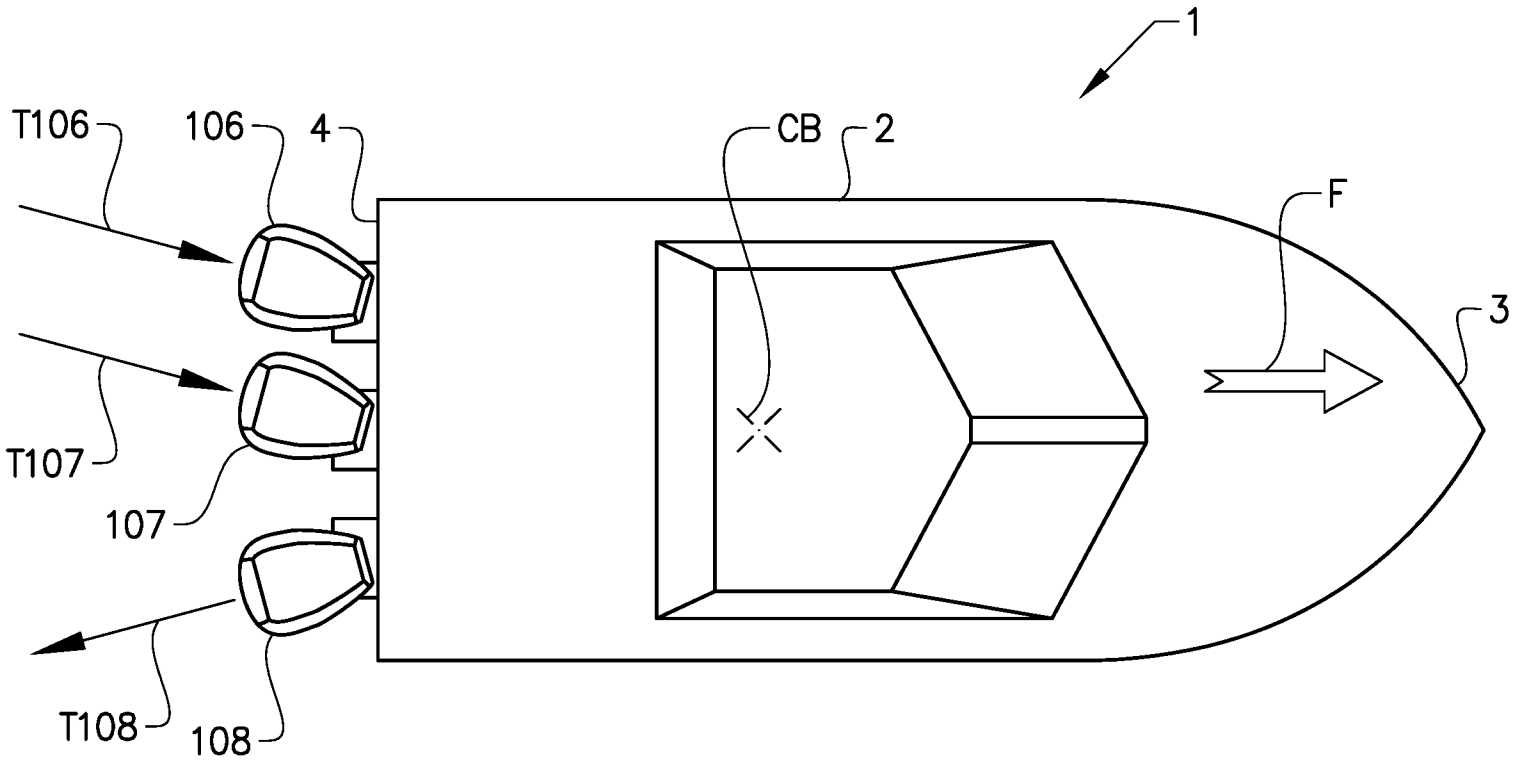
FIG. 6 is another top view of the vessel in FIG. 1.

As can be seen in FIG. 6, thereby the second propulsion unit 107 delivers a thrust T107 which intersects the center of buoyancy CB, and which is close to parallel with the thrust T106 of the first propulsion unit 106.

As can be seen in FIG. 3, simultaneously with engaging the gear GE of the second propulsion unit 107, the thrust delivered by the first propulsion unit 106 is decreased S5. This thrust decrease is also done within the propulsion unit engagement time interval UETI. The propulsion unit engagement time interval UETI is relatively short. Preferably, the engagement of the gear GE of the second propulsion unit 107 and the decrease of the thrust delivered by the first propulsion unit 106 are as close to each other as possible in time. The decrease of the thrust delivered by the first propulsion unit 106 will match the increase of thrust from the second propulsion unit 107 at the gear engagement thereof.

In addition, the thrust T106 of the first propulsion unit 106, shortly before engagement of the gear GE of the second propulsion unit 107, is substantially the same as the sum of the thrusts T106, T207 of the first and second propulsion units 106, 107, shortly after the engagement of the gear GE of the second propulsion unit 107. Thereby, at the transition from one to two propulsion units delivering thrust in reverse gear, the combined thrust is made continuous and smooth as shown by the line PR in FIG. 3.

In this example, at the third point in time t3, the throttle setting TH of the engine for the first propulsion unit 106 is decreased to a setting for idling of that engine. Further, when the gear GE of the second propulsion unit 107 is engaged, the throttle setting TH of the engine for the second propulsion unit 107 is at a setting for idling of that engine.

Figure 7:
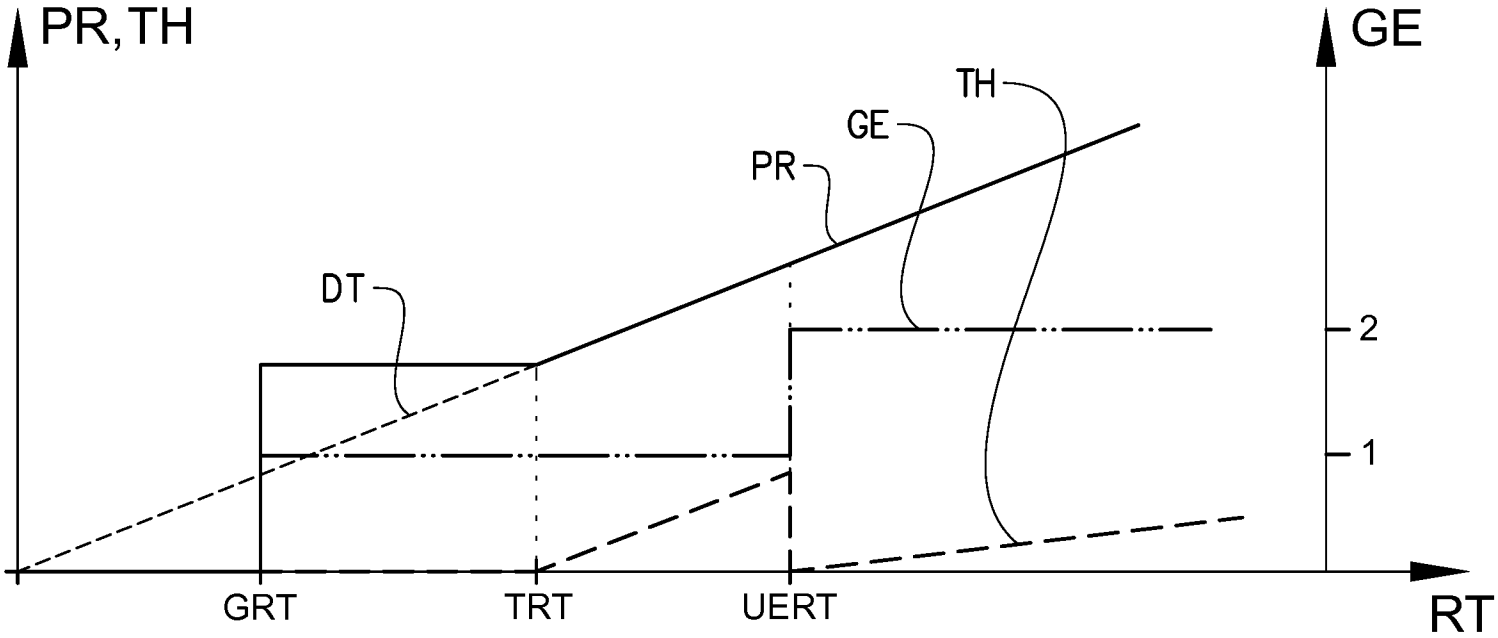
FIG. 7 is a diagram of parameters in the control system in FIG. 2 as functions of a requested thrust.

FIG. 7 shows as functions of a requested thrust RT from propulsion units in reverse gear, the number of propulsion units in reverse gear GE indicates, the combined thrust of the propulsion units in reverse gear PR, and the throttle settings TH of the engines the propulsion units in reverse gear.

The control unit 10 is arranged to send to the thrust controllers 1061, 1071 signals representing a requested thrust RT of the propulsion unit(s) 106, 107 which are in reverse gear during the sway movement. It can be seen in FIG. 7 that the steps of providing the gear engagement of the second propulsion unit 107 so as to increase the thrust delivered by the second propulsion unit 107 (from zero thrust), and decreasing the thrust delivered by the first propulsion unit 106 are carried out when the requested thrust RT is at a unit engagement requested thrust UERT. The unit engagement requested thrust UERT is preferably predetermined.

As can be seen in FIG. 7, within a requested thrust interval including the unit engagement requested thrust UERT, the sum of the thrusts PR in directions T106, T107 which have components in the forward direction F of the vessel, the sum of the thrusts PR from the propulsion units in reverse gear 106, 107 increases smoothly with an increasing requested thrust RT. In this example, the sum of the thrusts PR increases linearly with the requested thrust RT.

As can also be seen in FIG. 7, for each thrust in a direction T106, T107 which has a component in the forward direction F of the vessel, the degree of increase with an increasing requested thrust RT, of the throttle setting TH of the respective engine for the respective propulsion unit 106, 107, is inversely proportional to the number of propulsion units 106, 107, 206, 207, 208 delivering thrusts in directions T106, T107 which have components in the first direction F.

At a requested thrust of a gear engagement GRT of the first propulsion unit 106, there is a discontinuous increase of the thrust PR from the first propulsion unit. Further, up to a requested thrust TRT at which the throttle setting of the engine for the first propulsion unit 106 starts to be adjusted, the thrust PR from the first propulsion unit 106 is constant. The reason is that below the throttle adjustment requested thrust TRT, the throttle setting of the engine for the first propulsion unit 106 is at its lowest setting to provide an idle operation of the engine. Therefore, between the gear engagement requested thrust GRT and the throttle adjustment requested thrust TRT, the thrust PR from the first propulsion unit 106 is higher than a linearly increasing desired thrust, which is indicated in FIG. 7 with a broken line DT.

Of course for a sway movement in the opposite direction compared to the port direction described above, i.e. in the starboard direction, the first propulsion unit 106 is put in the forward gear, the third propulsion unit 108 is put in the reverse gear, and the second propulsion unit 107 is steered in the same direction as the third propulsion unit 108, and is engaged when the unit engagement requested thrust UERT (FIG. 7) is reached.

Figure 8:
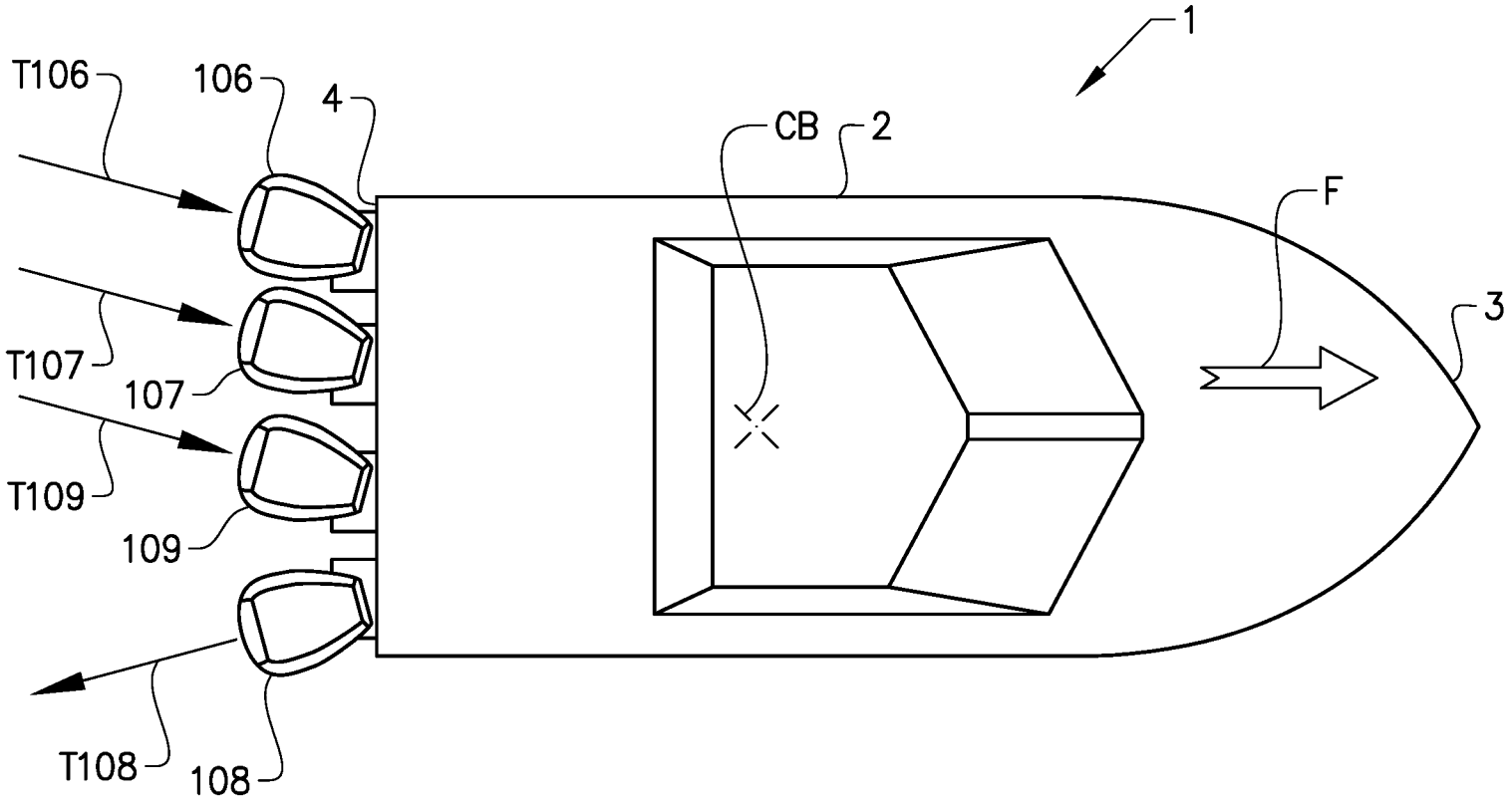
FIG. 8 is a top view of the vessel in an alternative embodiment of the invention.

FIG. 8 shows a vessel used in an alternative embodiment of the invention. The vessel has a so called quad installation with four outboard engines, each forming what is herein referred to as a propulsion unit. The propulsion units 106-109 are arranged and controlled similarly to the propulsion units 106-108 in the embodiment described above with reference to FIG. 1-FIG. 7. In addition to a first, second and third propulsion unit 106-108, the vessel in FIG. 8 presents a fourth propulsion unit 109.

At a sway movement to port the first, second and third propulsion units 106-108 are controlled similarly to what has been described above with reference to FIG. 1-FIG. 7. In addition to the unit engagement requested thrust UERT at which the second propulsion unit 107 is engaged, the method includes engaging the fourth propulsion unit 109 at an additional unit engagement requested thrust, which is higher than the unit engagement requested thrust UERT at which the second propulsion unit 107 is engaged. Thereby, an additional step of introducing a further reversing propulsion unit, as the requested torque is increased, is provided. When the fourth propulsion unit 109 is engaged, the thrusts of the first as well as the second propulsion unit 106, 107 are decreased.

It should be noted that although in the examples above, three or four propulsion units are provided, the invention is equally applicable on a vessel comprising five, six, seven or more propulsion units.

It is understood from the examples above that during a relatively low desired sideway force only one reversing propulsion unit 106, and one forward driving propulsion unit 108 is necessary. For a higher desired sideway force, instead of only increasing the rotational speed of the engine for the reversing propulsion unit 106, another reversing propulsion unit 107 is engaged. This will reduce noise and fuel consumption. Further, for each propulsion unit 107 engaged in addition to any previously engaged propulsion unit, the throttle setting of the engine for any previously engaged propulsion unit is reduced. This allows for reaching at the engagement of the further propulsion unit, an almost linear increase in the sum of the reversing thrusts.

Thus during sway movements, despite the grip of propellers being lower in a reverse operation compared to a forward operation, excessive engine noise and fuel consumption may be avoided due to the stepwise addition of propulsion units for matching the propulsion of a forwarding propulsion unit. Further, the reduced throttle setting of engines for the propulsion units already engaged in reverse will mitigate the sudden potential increase in reverse thrust by engaging an extra propulsion unit.

Figure 9:
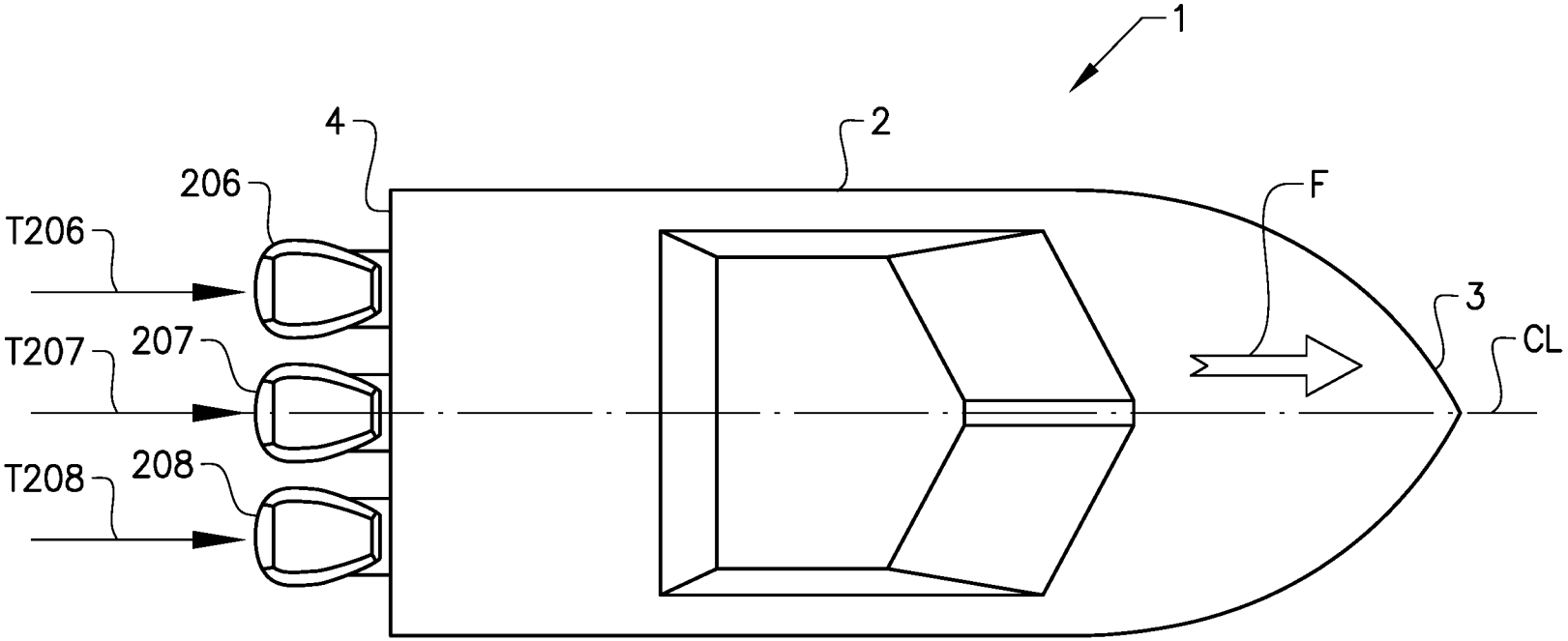
FIG. 9 is a further top view of the vessel in FIG. 1, during execution of a method according to yet another embodiment of the invention.

FIG. 9 shows a vessel 1 similar to the one described above with reference to FIG. 1-FIG. 7. However, for the method described here the propulsion units will be denoted as follows: A first propulsion unit 207 is located between a second and a third propulsion unit 206, 208, which are located on opposite sides of a longitudinal center line CL of the vessel.

In the method, a rearward surge movement is performed with a gradually increasing rearward joystick tilting by the handling of an operator. During this movement of the vessel all propulsion units 206-208 are straight, i.e. there is no steering angle of the propulsion units 206-208. The gear engagement GE, the throttle settings TH and the combined thrust PR are dependent on the requested thrust RT as shown in FIG. 6, referred to also above.

Figure 10:
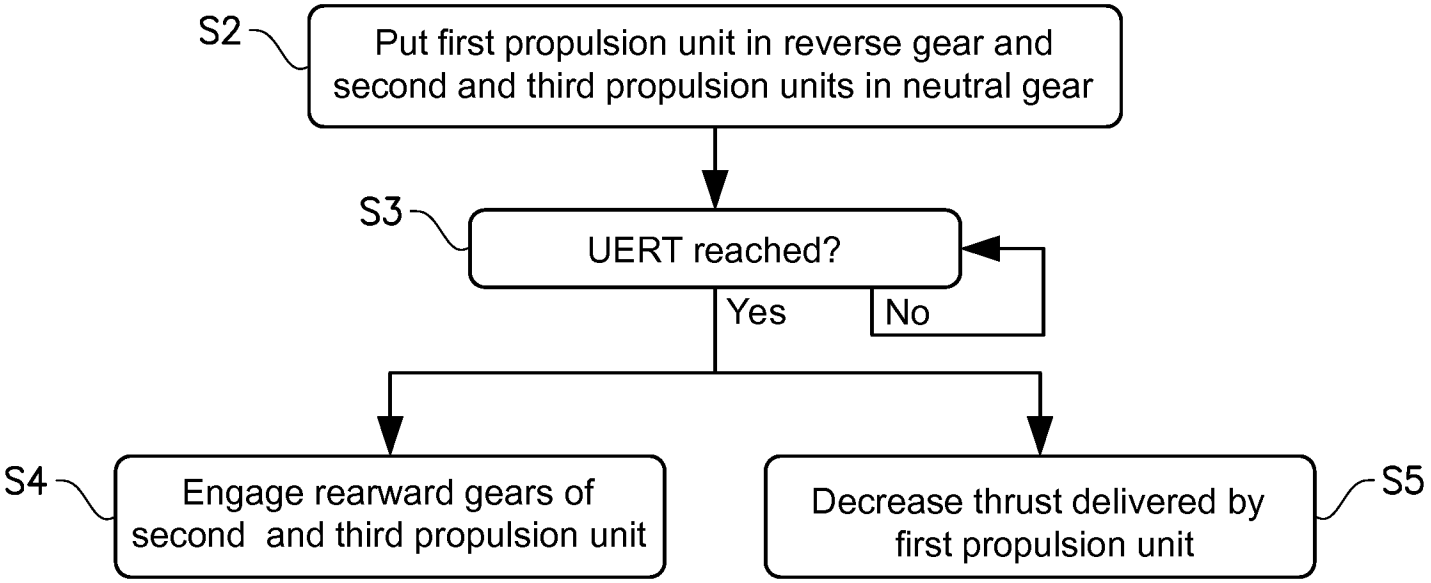
FIG. 10 is a block diagram depicting steps in the method described also with reference to FIG. 9.

Reference is made also to FIG. 10. Below the unit engagement requested thrust UERT (FIG. 6), the first propulsion unit 207 is controlled S2 so as to be in a reverse gear and to deliver a thrust in a direction T207 which is parallel to a forwards direction F of the vessel, and the second and third propulsion units 208, 206 are controlled S2 so as to deliver no thrust by being in neutral gears.

When a unit engagement requested thrust UERT has been reached S3, the second propulsion unit 208 and the third propulsion unit 206 are controlled S4 so as to enter reverse gears and to deliver thrust in directions T208, T206 which are parallel with the forward direction F of the vessel. Simultaneously with engaging S4 the reverse gears of the second and third propulsion units 208 206, the thrust delivered by the first propulsion unit 207 is decreased S5.

Thereby, similarly to the sway movement methods described above with reference to FIG. 1-FIG. 8, during a relatively low desired forward thrust for a reverse vessel surge movement, only one reversing propulsion unit 207 is necessary. Since the single reversing propulsion unit 207 is located on the vessel center line CL, it will move the vessel straight rearwards with no steering angle.

For a higher desired thrust for the rearward vessel movement, instead of only increasing the rotational speed of the engine for the reversing propulsion unit 207, two more reversing propulsion units 206, 208 are engaged. Since the additionally engaged propulsion units 206, 208 are located on opposite sides of the vessel center line CL, they will contribute to the movement of the vessel straight rearwards with no steering angles. In addition, avoiding increasing the rotational speed of the engine for the central reversing propulsion unit 207 will reduce noise and fuel consumption. Further, when the propulsion units 206, 208 are additionally engaged, the throttle setting of the engine for the previously engaged propulsion unit 207 is reduced. This allows for reaching at the engagement of the further propulsion units, an almost linear increase in the sum of the reversing thrusts.

It is to be understood that the present invention is not limited to the embodiments described above and illustrated in the drawings; rather, the skilled person will recognize that many changes and modifications may be made within the scope of the appended claims.

The invention claimed is:

1. A method for operating a marine vessel comprising a plurality of propulsion units, each being arranged to deliver thrust to water in which the vessel is floating, the thrust delivery levels of the propulsion units being individually controllable, the method comprising:

controlling a first of the propulsion units so as to deliver a thrust in a direction which has a component in a first direction of the vessel;

simultaneously controlling a second of the propulsion units so as to deliver less thrust than the first propulsion unit;

controlling a third of the propulsion units so as to deliver a thrust in a direction which has a component in a second direction of the vessel which is opposite to the first direction; and subsequently increasing, within a propulsion unit engagement time interval, the thrust delivered by the second propulsion unit in a direction which has a component in the first direction, wherein the step of subsequently increasing the thrust delivered by the second propulsion unit within the propulsion unit engagement time interval further comprises simultaneously decreasing the thrust delivered by the first propulsion unit within the propulsion unit engagement time interval, wherein the sum of thrusts having components in the first direction is substantially the same immediately before and immediately after the propulsion unit engagement time interval, wherein the sum of the thrust components in the first direction are substantially equal to the thrust component in the second direction, wherein the thrust delivery directions of the propulsion units are individually controllable, wherein the thrusts of the first, second and third propulsion units have thrust delivery directions with components in a third direction perpendicular to the first direction, and wherein the step of controlling the second propulsion unit so as to deliver less thrust than the first propulsion unit comprises controlling the second propulsion unit so as to deliver substantially no thrust.

2. A method according to claim 1, characterized in that each of the propulsion units comprises a propeller.

3. A method according to claim 1, where the propulsion units are arranged to be controlled with control signals representing a requested thrust of the propulsion units, characterized in that the steps of increasing the thrust delivered by the second propulsion unit and decreasing the thrust delivered by the first propulsion unit are carried out at a unit engagement requested thrust, and that within a requested thrust interval including the unit engagement requested thrust, the sum of the thrusts in directions which have components in the first direction increases smoothly with an increasing requested thrust.

4. A method according to claim 1, where the propulsion units are arranged to be controlled with control signals representing a requested thrust of the propulsion units, characterized in that, for each thrust in a direction which has a component in the first direction, the degree of increase with an increasing requested thrust, of an output torque of a respective power source for driving the respective propulsion unit, is inversely proportional to the number of propulsion units delivering thrusts in directions which have components in the first direction.

5. A method according to claim 1, characterized in that the first direction is a forward direction of the vessel.

6. A method according to claim 1, wherein the third direction is horizontal and perpendicular to an intended direction of straight travel of the vessel.

7. A method according to claim 1, characterized in that the first and third propulsion units are located on opposite sides of a longitudinal center line of the vessel, and the second propulsion unit is located between the first and third propulsion units.

8. A method according to claim 1, characterized in that the thrust of at least one of the first, second, and third propulsion unit intersects a center of buoyancy of the vessel.

9. A method according to claim 1, characterized by, simultaneously with the step of controlling the second propulsion unit so as to deliver less thrust than the first propulsion unit, controlling a third of the propulsion units so as to deliver less thrust than the first propulsion unit, and, simultaneously with increasing the thrust delivered by the second propulsion unit, increasing the thrust delivered by the third propulsion unit in a direction which has a component in the first direction.

10. A method according to claim 9, characterized in that the second and third propulsion units are located on opposite sides of a longitudinal center line of the vessel, and the first propulsion unit is located between the second and third propulsion units.

11. A computer program comprising program code means for performing the steps of claim 1 when said program is run on a computer.

12. A computer readable medium carrying a computer program comprising program code means for performing the steps of claim 1 when said program product is run on a computer.

13. A control unit configured to perform the steps of the method according to claim 1.

14. A marine propulsion control system comprising a control unit according to claim 13.

15. A marine vessel comprising a marine propulsion control system according to claim 14.

* * * * *